US005595094A

United States Patent [19]

Negus

[11] Patent Number: 5,595,094

[45] Date of Patent: Jan. 21, 1997

[54] OIL FILTER WRENCH

[75] Inventor: Joel A. Negus, Clarinda, Iowa

[73] Assignee: The Lisle Corporation, Clarinda, Iowa

[21] Appl. No.: 369,380

[22] Filed: Jan. 6, 1995

[51] Int. Cl.[6] ..... B25B 7/04

[52] U.S. Cl. ..... 81/3.44; 81/394; 81/407; 81/476.5

[58] Field of Search ..... 81/3.44, 341, 394, 81/405–407, 411–412, 416–419, 426.5

[56] References Cited

U.S. PATENT DOCUMENTS

| | | | |
|---|---|---|---|
| D. 114,211 | 4/1939 | Francke | 81/3.44 |
| 601,506 | 3/1898 | Eames . | |
| 1,305,873 | 6/1919 | Briggs | 81/412 X |
| 1,366,871 | 1/1921 | Calkins | 81/3.44 X |
| 1,643,835 | 9/1927 | Carlson | 81/412 |
| 1,661,365 | 3/1928 | Gendron | 81/426.5 X |
| 1,668,474 | 5/1928 | Wells | 81/426.5 X |
| 2,495,308 | 1/1950 | Amigone | 81/3.44 |
| 3,910,140 | 10/1975 | Rose . | |
| 4,232,573 | 11/1980 | Dace . | |
| 4,517,821 | 5/1985 | Taggart et al. . | |
| 4,581,960 | 4/1986 | Putsch et al. . | |
| 4,726,265 | 2/1988 | Reich . | |
| 5,291,810 | 3/1994 | Lins . | |

OTHER PUBLICATIONS

Submission made by J. W. Burnette, Mar. 3, 1954.
Submission made by Steve Michels, Jan. 6, 1976.
Submission made by Ivan L. Rose, Aug. 3, 1976.
Submission made by Sydney T. Jobe, May 23, 1982.
Submission made by Howard E. Lamphere, Jr., Feb. 28, 1979.
Submission made by Lloyd Neubauer, Mar. 16, 1984.
Submission made by Mike Barton, Mar. 14, 1985.
Submission made by Gary Boergerman, Dec. 7, 1988.
Submission made by C. S. Christian, Oct. 23, 1989.
Submission made by Mr. Charles Latom, Mar. 24, 1994.
K–D Tools, "New Tool News", Oct. 1992.

*Primary Examiner*—D. S. Meislin
*Attorney, Agent, or Firm*—Banner & Allegretti, LTD.

[57] ABSTRACT

An oil filter wrench dimensioned and constructed in a fashion which will accommodate a broad range of sizes of cylindrical oil filters. The handles and jaws of the oil filter wrench are substantially identical. One of the jaws, however, has a pin and the other jaw has a pair of openings to define first and second pivot axes for the pliers.

1 Claim, 3 Drawing Sheets

OIL FILTER WRENCH

BACKGROUND OF THE INVENTION

The invention relates to an oil filter wrench and, more particularly, to an oil filter wrench which is convertible from a large jaw opening size to a small jaw opening size.

Oil filter wrenches or oil filter wrench pliers are available in the marketplace in the form of a pliers having a pair of handles with integral jaws. The jaws serve as arcuate gripping members which fit around a cylindrical oil filter to effect removal from an engine. Heretofore, oil filter wrench pliers have been available in various sizes depending upon the diameter of the cylindrical oil filter to be removed from an engine. For example, pliers capable of removing cylindrical or canister type oil filters having a diameter in the range of two (2) to three (3) inches would be effected by a smaller pliers construction. Larger diameter filters, for example those having three (3) to four (4) inch diameter cylinders, would be removed by a separately sized pliers wherein the jaws are larger and spaced further apart.

It has been recommended that oil filter wrench pliers be convertible or changeable so that the pivot point associated with the connection between the separate handles forming the pliers could be altered thereby enabling the oil filter wrench to accommodate large as well as small diameter cylindrical oil filters. There has remained, however, a need for a wrench construction for oil filters convertible from a first diameter to a second diameter wherein the handles, which are manually gripped, may be generally uniformly spaced when the pliers accommodates variously sized cylindrical oil filters. Thus, there has remained a need to provide an improved design for a convertible oil filter wrench which enables gripping a wide range of diameters of cylindrical canisters or oil filters.

SUMMARY OF THE INVENTION

In the principal aspect, the present invention comprises an oil filter wrench which has a pair of opposed jaws each jaw being integrally formed with a handle. The handles are pivotally connected by means of a pivot pin projecting from one handle through a pivot opening in the other handle. The pivot pin opening comprises two separate pin openings which are connected so that the pivot pin can be positioned in either one or the other of the openings to thereby change the pivot axis for the oil filter wrench pliers of the invention. By carefully choosing the ratio of the length of the handles, the position of the pivot axis, the shape and curvature of the integral jaws and various other dimensional features, it is possible to provide an oil filter wrench having a broad range of utility.

Thus, it is an object of the invention to provide an improved oil filter wrench pliers.

It is a further object of the invention to provide an improved oil filter wrench pliers comprised of two handles having a substantially identical construction with integral, arcuate jaw members and wherein the separate handles are engaged to define a pliers connected by a pivot pin projecting from one of the handles through one of a pair of connected openings of the opposite handle.

It is a further object of the invention to provide an oil filter wrench pliers wherein the handles, when in an operative position, are substantially uniformly spaced over a wide range of jaw separations of the jaws which grip an oil filter. In this manner, the jaws can be easily positioned on a cylindrical filter and maintained in tight relationship by means of manual gripping of the handles. That is, the handles may be appropriately spaced so as to maximize the manual gripping pressure thereon and to maximize, in turn, the efficiency of the oil filter wrench.

It a further object of the invention to provide an oil filter wrench pliers comprised of convertible connected handles and integral jaws which utilize substantially identical handles and jaws for the construction of the pliers.

Another object is to provide an oil filter wrench which is economical to manufacture, easy to use, rugged and durable.

These and other objects, advantages and features of the invention will be set forth in the detailed description which follows.

DRAWINGS

In the detailed description which follows, reference will be made to the drawing comprised of the following figures.

DESCRIPTION OF THE PREFERRED EMBODIMENT

Figure 1:
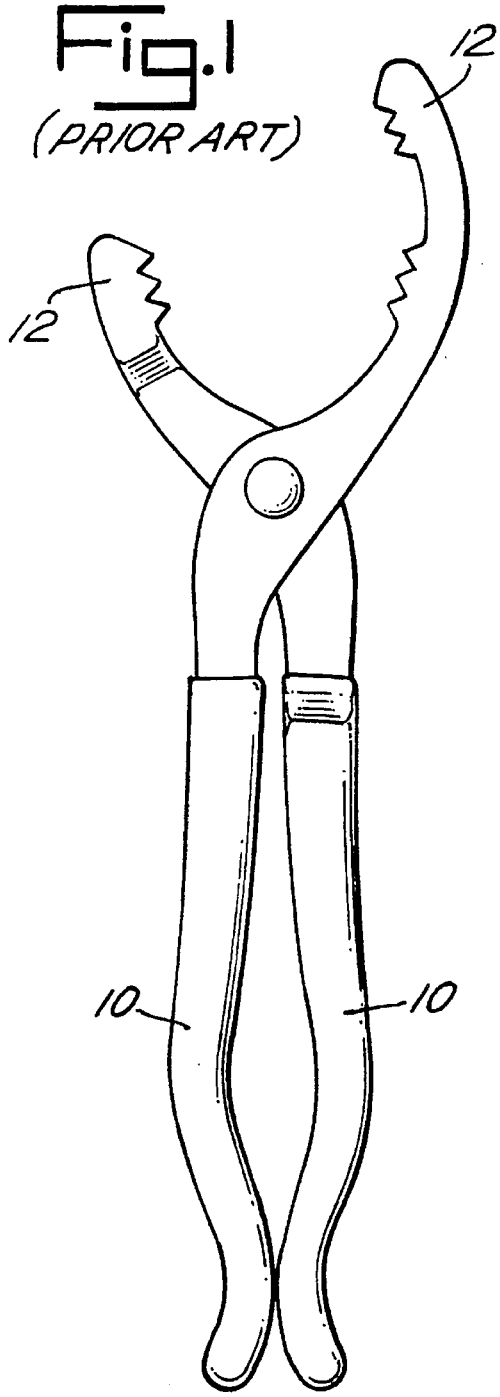
Fig. 1 (PRIOR ART)
FIG. 1 is a plan view of a prior art oil filter wrench having a small diameter capacity.
Figure 2:
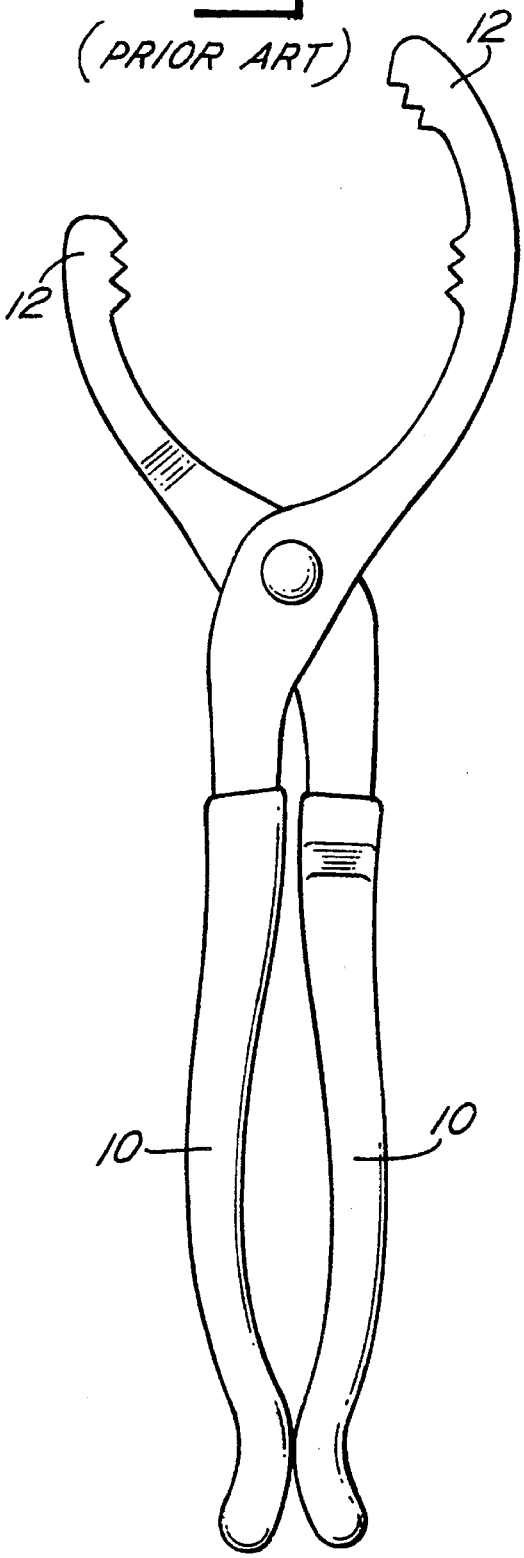
Fig. 2 (PRIOR ART)
FIG. 2 is a plan view of a prior art oil filter wrench having a large diameter capacity.

FIGS. 1 and 2 depict two prior art wrenches. FIG. 1 depicts an oil filter wrench pliers which is adapted to engage and remove generally smaller, cylindrical oil filters. FIG. 2 illustrates a separate oil filter wrench pliers adapted to engage larger diameter oil filters for removal and replacement. The oil filter wrench pliers of FIGS. 1 and 2 differ structurally as a result of their differences in dimension. That is, the length of the manual handles 10 which are gripped to operate the pliers is different. The length of the jaws or tongs 12 which are designed to grip the cylindrical oil filter is different. The arcuate curve or radius of curvature of the jaws 12 which are designed to grip an oil filter is different. The differently sized oil filter wrench pliers are considered necessary in order to effectively engage and turn a cylindrical oil filter using pliers such as shown in FIGS. 1 and 2. The pliers of FIG. 1 is thus not useful for engaging and removing a large diameter cylindrical oil filter. Similarly, the construction of FIG. 2 is not useful for engaging and removing a small diameter cylindrical filter construction.

The remaining Figures illustrate the improved wrench or pliers of the present invention which is designed to be useful for removal of cylindrical oil filters having a wide range of diameters. In other words, the pliers depicted in the remaining figures is useful for removal of oil filters of the size and dimension which may be removed by the pliers of FIGS. 1 and 2. The improved oil filter wrench pliers of the present invention is enabled to perform its broader range of tasks by virtue of a series of unique features which in combination enable such utility. For example, the pliers includes a pivot axis connection which may be altered or changed by sliding between a first and second position. Additionally, numerous dimensional relationships regarding the construction of the jaws, the construction of the handles, the length of the handles, the arcuate dimensions of the jaws, the positioning of the pivot axis and the spacing of the pivot axis all in combination provide a pliers which permits the utilization of the oil filter wrench pliers for a broad range of oil filters of varying diameter.

Figure 3:
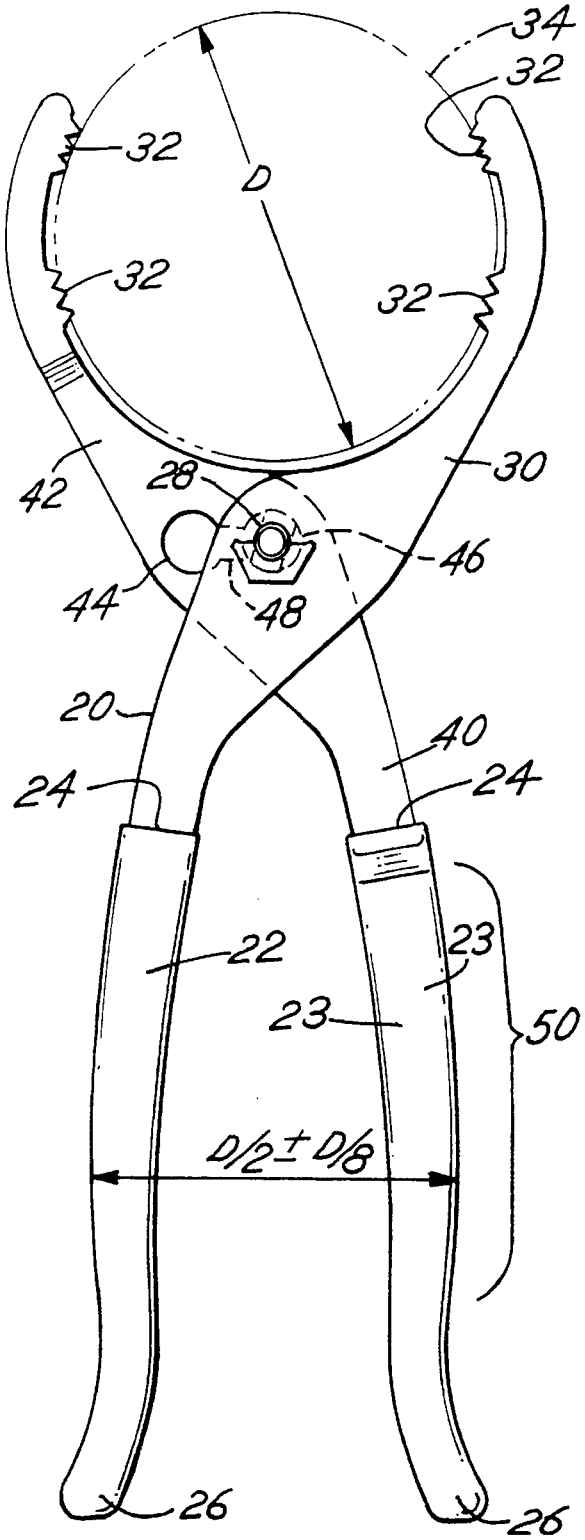
FIG. 3 is a top plan view of the improved pliers of the invention configured to accommodate larger diameter cylindrical oil filter containers.

Referring therefore to the remaining figures, the basic construction of the wrench or pliers of the present invention is similar to that of the prior art in that the construction has a pliers configuration comprised of a first or fixed pivot arm 20 which has a manual handle 22 with a molded grip 24 slidably mounted thereon. The handle 20 has an outside end 26 and an elongated run extending from the outside end 26 to a pivot pin 28. Extending from the handle 20 as a continuation thereof is a first integral fixed jaw 30. Jaw 30 defines an arcuate, concave curve and includes first and second groups of inwardly projecting teeth 32 which act to grip the outside surface of a cylindrical canister or oil filter 34. The oil filter canister 34, which is depicted in FIG. 3, is, for purposes of this disclosure, a larger diameter oil filter 34. The general diameter of the larger diameter canister 34 is defined by the dimension, D. This is contrasted with the diameter of a smaller diameter oil filter which is adapted to be gripped by the pliers construction of the invention which is represented by the diameter, D/1.5 in FIG. 4. Thus, the range of sizes of oil filter diameters cooperative with the pliers of the invention extends at least between the range of D to D/1.5. FIG. 3 illustrates the larger diameter operation of the oil filter wrench.

Figure 4:
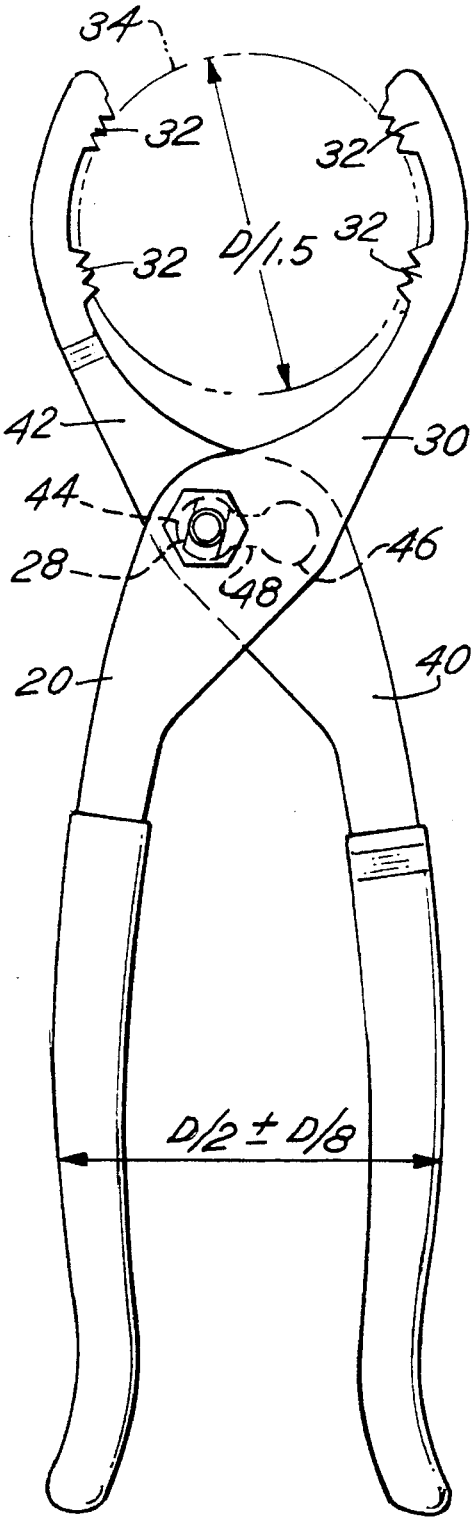
FIG. 4 is a top plan view similar to FIG. 1 wherein the pliers of FIG. 1 have been converted to a configuration for handling or gripping smaller diameter cylindrical containers.
Figure 6:
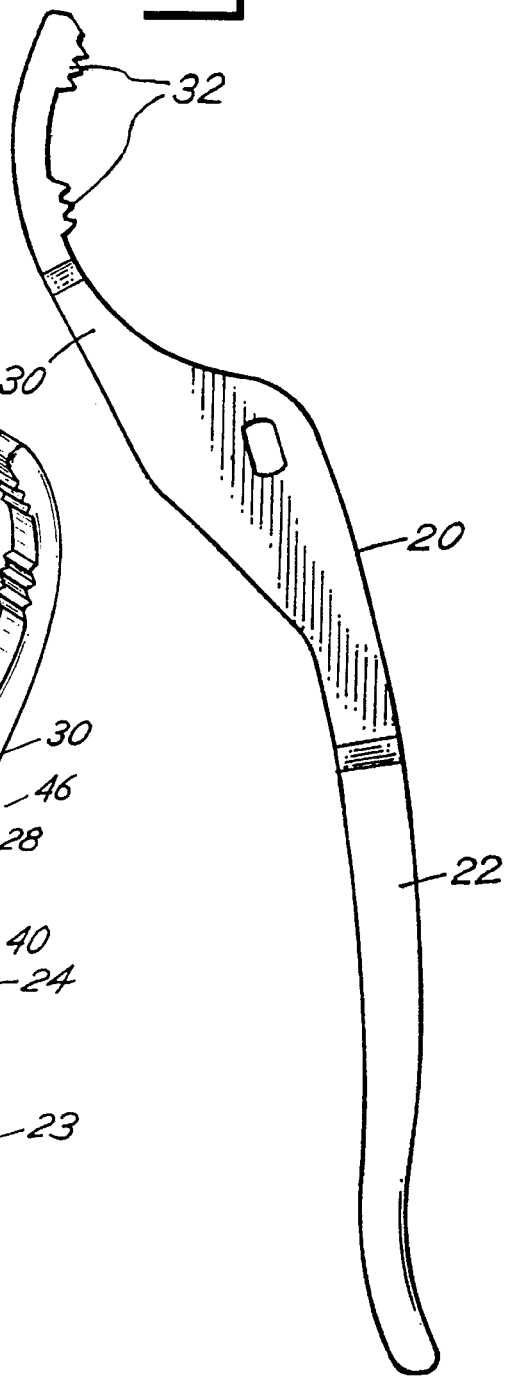
FIG. 6 is a top plan view of one of the handles and integral jaw members.
Figure 7:
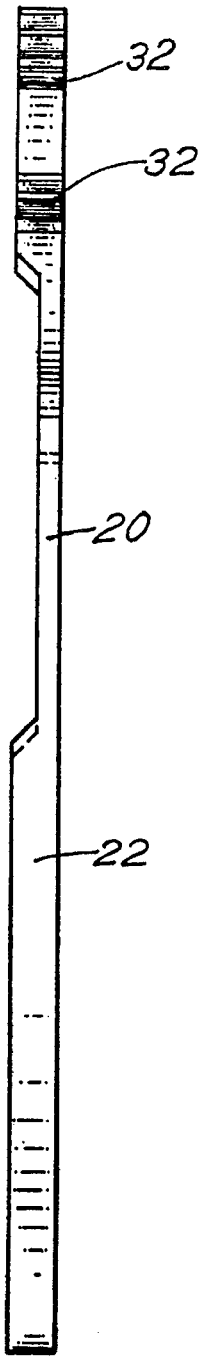
FIG. 7 is a side view of the handle of FIG. 6.
Figure 5:
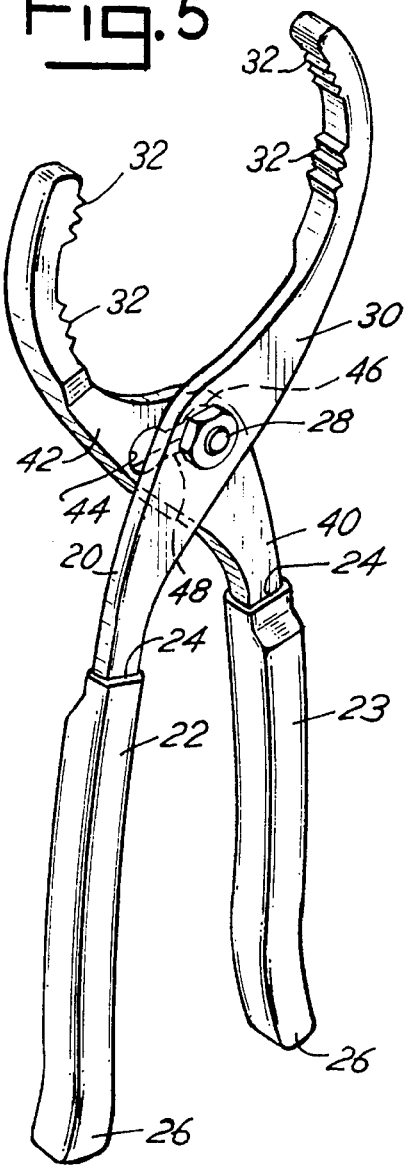
FIG. 5 is an isometric view of the pliers of FIG. 3.

FIG. 4 represents the smaller diameter operation.

The handle 20, and more particularly the elongated run 22 thereof, has a dimension from the outside end 26 to the pivot pin 28 in the range of 2D±D/2. The handle 20 is designed to swing or move in a plane with the pin 28 projecting in a perpendicular manner from that plane. The pin 28 has an elongated, generally rectangular cross section shape as depicted in FIG. 3 so that it can cooperatively slide between pin openings 44, 46 in second handle or moveable pivot arm 40. Handle 40 includes an attached integral jaw 42.

The handle 40 and integral jaw 42 are substantially identical to the handle 20 and integral jaw 30. The handles 20 and 40 are thus inverted during the assembly of the pliers of the present invention with the pivot pin 28 coacting with openings 44 and 46 defined in handle 40. The openings 44 and 46 are connected by a run or slot 48. Thus, the pin 28 may slide between the openings 44 and 46 to change the relative pivot axis of handle 20 relative to handle 40 and also of jaw 30 relative to jaw 42. As mentioned previously, the jaw 30 and thus the jaw 42 define a concave arcuate gripping member. The radius of curvature of this member is in the range of D/2±0.25 D. The arcuate extent of the jaw 30 as well as the jaw 42 is preferably greater than πD/4.

The pin 28, as previously mentioned, fits in one of the openings 44 or 46 to effect a pliers like or pivoting action. The openings 44 and 46 define pivot centers for the pin 28 therefor and are spaced from one another in the range of a distance of D/6±D/18. In this manner, the pin 28 may be engaged and positioned in the opening 46 so that the jaws 30 and 42 can efficiently and effectively grip a cylindrical oil filter having a diameter, D. Simultaneously, the handles 20 and 40 are spaced a distance of D/2±D/8. This spacing is the average spacing between the handles 20, 40 along their length in the region where manual gripping would take place, in other words, the spacing in the region defined as the gripping region 50 in the Figures.

Similarly, when the pin 28 is engaged in the opening 44 as shown in FIG. 4, the jaws 30 and 42 are positioned about a cylinder having a diameter of D/1.5 and the spacing of the handles 20 and 40 is again D/2±D/8. This spacing of the handles 20, 40 enables one to manually grip the handles 20, 40 and easily and effectively rotate a cylindrical oil filter. It is appropriate, if not necessary, to keep this spacing as uniform as possible regardless of the size of the cylindrical canister which is being engaged in order to more efficiently twist or turn the cylindrical oil filter. A mechanical advantage is thus achieved and an ease of operation of the device is maintained when the handles 20, 40 are at a substantially uniform distance and are maintained at such a uniform distance regardless of the size of the cylinder which is being engaged.

It is possible to vary the construction of the invention without departing from the true scope thereof. For example, the arrangement of the teeth on the arcuate jaws may be varied. The shape of the handles may be varied or amended slightly to have certain curvatures which facilitate the operation of the pliers.

Thus, the invention is limited only by the following claim and equivalents.

What is claimed is:

1. An oil filter wrench having opposed jaws for turning generally cylindrical oil filters about their cylindrical axis by gripping the cylindrical surface thereof, said wrench of the type which comprises a pliers construction convertible between a first reduced diameter jaw opening size and a second increased diameter jaw opening size to thereby accommodate a broad range of sizes of cylindrical oil filters, said jaws being arcuate and having a diameter, D, of a circle defined by the arcuate shape of the jaw, said wrench comprising, in combination:

a first, fixed pivot arm having a manual handle for movement in a plane, said handle having an outside end and a run extending from the end for a distance in the range of 2D±D/2 to a fixed pivot pin, said fixed pivot pin defining a pivot axis perpendicular to the plane;

a first integral jaw extending from the handle away from the pivot pin, said first jaw defining a concave arcuate gripping member having a radius of curvature in the range D/2 and a circumferential extent greater than πD D/4, said member including a plurality of teeth projecting radially inward for engaging a cylindrical surface;

a second pivot arm with a movable pivot and attached integral jaw, said second arm and jaw substantially identical to the fixed pivot arm and integral jaw, said second jaw including first and second connected, spaced openings for the pivot pin whereby the pivot pin may be slidably moved between the openings, said first and second pivot arms and integral jaws pivotally joined by the pivot pin through an opening to provide a pliers construction with the concave integral jaws opposed to define means for encircling and gripping a cylindrical filter, said openings having pivot centers spaced apart in the range of D/6±D/18; whereby the pivot pin engages the first opening and the jaws are spaced to define a gripping diameter D/1.5 as the handles are spaced a distance of D/2±D/8 in the plane of movement defined by the handles and whereby the pivot pin engages the second opening and the jaws are spaced to define gripping a diameter D as the handles are spaced a distance D/2±D/8 in the plane of movement defined by the handles.

* * * * *